United States Patent [19]

Kronseder

[11] Patent Number: 4,844,769

[45] Date of Patent: Jul. 4, 1989

[54] LABELING DEVICE WITH PRINT MECHANISM MONITOR

[76] Inventor: Hermann Kronseder, Regensburger Strasse 42, 8404 Worth Donau, Fed. Rep. of Germany

[21] Appl. No.: 179,508

[22] Filed: Apr. 8, 1988

[30] Foreign Application Priority Data

Apr. 13, 1987 [DE] Fed. Rep. of Germany ..... 3712554

[51] Int. Cl.[4] ..... B65C 9/16

[52] U.S. Cl. ..... 156/378; 156/384; 156/566; 156/568

[58] Field of Search ..... 156/356, 357, 578, 350, 156/568, 567, 566, 378, 365

[56] References Cited

U.S. PATENT DOCUMENTS 3,736,213 5/1973 Jorss et al. ..... 156/570

4,210,481 7/1980 Wolff et al. ..... 156/357

4,445,961 5/1984 Kronseder et al. ..... 156/364

FOREIGN PATENT DOCUMENTS 2141306 5/1972 Fed. Rep. of Germany .

*Primary Examiner*—David Simmons

*Attorney, Agent, or Firm*—Fuller, Puerner & Hohenfeldt

[57] ABSTRACT

In a labeling apparatus a rotor orbits palettes past a glue roller to receive a coat of glue and then to a labeling magazine to pick up a label. The label is carried past a printing mechanism which prints coded information on the label after which a gripping cylinder removes the labels from the palettes for subsequent application of the labels to containers such as bottles. To insure error free operation of the printing mechanism, a reading head is located between the printing mechanism and the gripper cylinder for monitoring the imprint on the labels.

6 Claims, 3 Drawing Sheets

LABELING DEVICE WITH PRINT MECHANISM MONITOR

BACKGROUND OF THE INVENTION

The invention disclosed herein relates to apparatus for applying labels to containers such as bottles. In particular, the invention pertains to a device for monitoring labels before they are applied to bottles to determine if coded information, such as the date on which the container was filled, has been properly applied by a printing mechanism to the labels.

Labeling machines of the type with which the new monitoring system can be used typically draw labels from a stack of labels in a magazine by means of palettes which oscillate rotationally as they are orbited on a rotor. The oscillating or partially rotating curved palettes move past a glue roller where they acquire a thin film of glue. The palettes then roll over the surface of the foremost labels in the magazine so the labels are picked up by the adhesive force of the glue. The exposed sides of the labels which are uncoated with glue then pass a printing mechanism where coded information is printed on the labels. After the information is printed, the labels, which are still carried on palettes, are rotated into proximity with a gripping cylinder which removes the labels from the palette surfaces and carries them onward to the transport path of the container which is to be labeled.

When there are printing mechanism malfunctions such as the printing mechanism running out of ink, the labels proceed without having the filling date or other coded information printed on them. Bottles from which the filling date are missing are not allowed to be sold under the law of some countries. The seriousness of the problem can be appreciated from realization that modern labeling machines of the type outlined above carry out up to twenty-one labeling operations per second so if there is a printing mechanism defect for only a short time, a substantial economic loss can result.

SUMMARY OF THE INVENTION

An objective of the invention is to provide a device for monitoring or detecting the occurrence of errors in the coded information resulting from malfunction of the printing mechanism.

Briefly stated, monitoring or detecting defective or missing printing is accomplished by having a detector such as a reading head arranged for monitoring the imprint as the labels are moving between the printing mechanism and the gripping or label pickup cylinder. Locating the detector or reading head between the printing mechanism and the gripping cylinder affords an opportunity to determine whether or not the coded information has been printed on the label. The inspection device comprised of a reading head or other detection device can be used to operate apparatus which can stop operation of the machine if several labels successively appear without an imprint. The signal from the information reading head can also be used when printing errors are not continuous but occur only sporadically to operate an ejector which removes any bottle that has not been properly imprinted. As a result of arranging the reading head between the printing mechanism and the gripping cylinder, any error occurring in printing can be very reliably determined because the reading conditions are optimal near the rotor or carousel that orbits the glue coated palettes. Since the curved palette surfaces oscillate rotationally in a very precise manner, usually with deviations of no more than 0.01 mm, the relationship of the palette surfaces and the reading head can be maintained very precisely. The detector or reading head can be accurately adjusted to grasp the individual labels at the same location, namely, in the region where the imprints are to be applied. If the monitoring were carried out on the bottle transporting table after the labels had been removed from the palettes, more difficult reading conditions would exist because of imprecisions resulting from bottle and machine part position tolerances. Additionally, if bottles of various sizes are to be labeled and the imprint monitored after labeling, it would be necessary to provide adjusting means to adapt for different distances between the bottles and reading head. Also, if the printing would need to be applied at various locations on the label, variously adapted table curves would have to be used. Having the printing head viewing the labels while they are still on the palettes means that the monitoring device is at some distance from the bottles so that if any bottle breaks, there is little if any, danger that the reading head could be damaged by flying glass splinters or liquid.

A variety of different print detectors can be used in the invention such as electro-optical reading heads or magnetic reading heads. Reflex light beam scanners can be used as electro-optical reading heads. A character reader can also be used as a print detector which can not only determine the presence or absence of an imprint, but can also read the imprint.

The invention is suitable for monitoring the print on labels regardless of the kind of printing mechanism that is used to apply the print such as type wheel printers, laser daters, laser printers, ink jet daters, or heated stamps, for example.

The new label print monitoring device can be used with different labeling devices such as where the palette surfaces contact a rotating cylinder or with labeling devices where the palette carrying rotor features upright individual palette shafts which carry at least one palette that has the shape of a sector of a circle and that have a control cam which guides the outer surfaces of the individual label pick up palettes past the reading head.

The invention can also be employed in labeling machines in which the radius of curvature of the label pick up palettes is smaller than the radius of curvature of the circular path of the palettes in which case the control cam is constructed such that it oscillates the palettes while they are moving in a circular path or an orbit. In one labeling machine of this type, according to the invention, a control cam is advantageously used that causes the center point of the individual palette curved surfaces to swivel around the sighting end herein called the "eye," of the reading head in a circular path. This arrangement is preferably employed when the distance from the reading head to the imprint being monitored only permits small tolerance, that is, when the reading head has a very limited depth of field. By controlling the individual palettes this way, the imprint always passes the sighting end or eye of the reading head or detection device at a constant distance to the focal plane of the reading head so that the reading head can be adjusted for a sharp focus at that distance to assure precise observation.

The imprint monitor can also be used with a control cam that maintains the center of curvature of the palettes stationary along the line between the palette rotor axis and the detector eye. This arrangement has the advantage of the eye always pointing vertically onto the part of the imprint which has just traveled past so that observation can be carried out precisely with reflected light independently of the length of the imprint. This arrangement does require a rapid swivel or oscillating motion of the individual palettes because of the rapid rotational movement of the palette rotors which requires correspondingly greater forces.

One embodiment of the invention that is presently considered preferred provides for the print to be applied to the label symmetrically relative to the center axis or axis of symmetry of the sector shaped label pick-up palettes where the control cam is constructed in such a way that the center axis of the palettes lies in front of the eye of the reading head along a radial line of the palette rotor when the advancing edge of the imprint approaches and remains aligned in the radial direction of the rotor until the trailing edge of the imprint has passed by the reading or inspecting eye. With this arrangement, the individual palettes are held in place after taking on the aligned position in which the center axis of the palettes and, also the center of the imprint, are aligned in the radial direction and they are then moved past the reading head in this fixed position. As a result, low forces are required for guiding the individual palettes while a slight limitation to the imprint must be considered since the reflex light beam can only be captured within a specific angular range by the reading head.

A more detailed description of a preferred embodiment of the invention will now be set forth in reference to the drawings.

DESCRIPTION OF A PREFERRED EMBODIMENT

Figure 1:
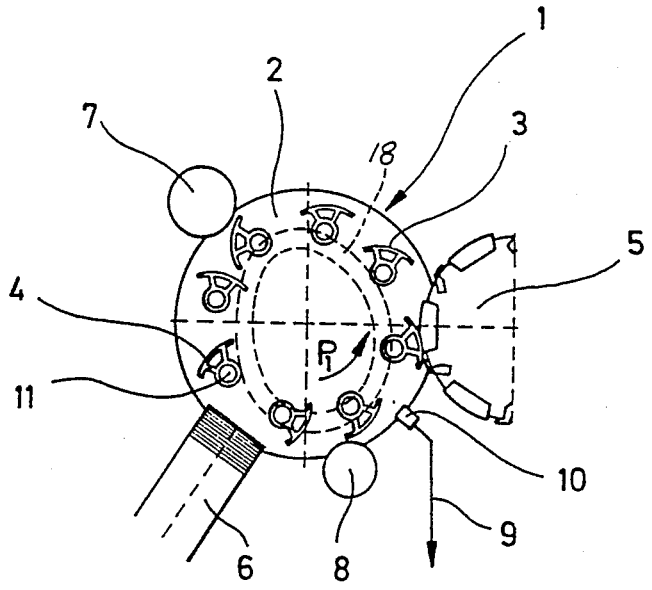
FIG. 1 is a schematic top view of a labeling machine incorporating the invention.

In FIG. 1, the schematic representation of the labeling device containing the invention is designated generally by the reference numeral 1. The labeling device comprises a palette rotor 2 which has label pick-up palettes 4 equiangularly spaced around the rotor. In this embodiment, eight palettes 4 are shown. Palettes 4 are fastened to palette shafts 11 which are acted upon by a control cam 18 which is shown schematically in dashed lines, in such manner that the palette surfaces 3 of the palettes 4 are swivelled back and forth during a rotation of the rotor that corresponds to a movement path initiated by the control cam. The control cam is basically like the cam shown in U.S. Pat. No. 4,445,961. The palette rotor 2 which carries the individual swivelling or oscillating glue palettes 4 which swivel about the palette shafts 11, rotates at high speed during operation in the direction of the arrow $P_1$. When the palette rotor 2 is rotating, the individual palettes 4 pass a glue roller 7 where the palettes pick up a thin coat of glue on their curved surfaces 3. Surfaces 3 are sectors of a circle. The glue coated palette surfaces 3 then travel past the unprinted side of a label in label magazine 6 where the palettes pick up the foremost label in the magazine. The label adhering to the palette surface is then guided past a printing mechanism 8 which prints the bottle filling date, for example, at a predetermined place on each label. Finally, the label reaches the gripping cylinder 5 which pulls the label from the palette surface and leads it to objects, such as bottles, which are to be labeled in a well known manner. The events so far described are known.

The invention resides in providing a reading head for monitoring whether or not the information is properly printed on the label. The invention features locating the coded information reading or inspecting head 10 between the printing mechanism 8 and the gripping cylinder 5. The reading head can be of the type which determines whether an imprint has been made at the desired location on the label or it can be of the type which consists of a camera which can analyze or determine the type of imprint that has been applied. Arranging the reading head 10 in close proximity to the palette rotor 2 makes it possible to monitor the printing position exactly since the palettes on the rotor and, hence, the labels follow a very precise path. Thus, the reading head 10 can reliably determine whether the printing mechanism 8 is functioning correctly. If the reading head 10 indicates that the position intended for an imprint does not contain an imprint, for example, the head transmits an appropriate signal by means of signal line 9, which signal can be used for control purposes. An optical or acoustic alarm, not shown, can be operated with the signal. It is also possible to use the signal to automatically eject a container that is without an imprint or the control can be adapted to shutting down the labeling machine if numerous labels or imprints are indicated to be absent by the reading head 10. But the label carrying palettes 4 must travel past the reading head 10 in such a way that it can monitor the printing reliably. The path of movement of the palettes past the reading head depends on the type of reading head which is used as will be explained hereafter in reference to FIGS. 2 to 4.

Figure 2:
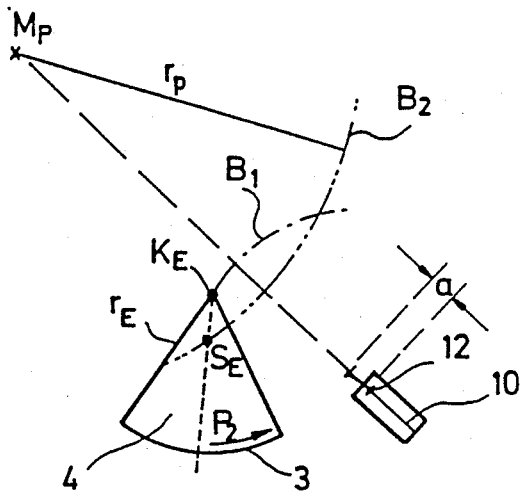
FIG. 2 is a diagram of an embodiment of the invention in which a glue coated palette swings past the reading head with its center of curvature guided around the optical eye of the reading head in a circular path.

In the FIG. 2 embodiment, a reading head is employed which is sensitive to changes in depth of focus, that is, the reading head is of the type which requires only a low tolerance with regard to the distance between the head and the label to function properly. The reading head 10 is equipped, as in the other embodiments, so that the optical axis of the reading head points toward the center of rotation of the palette rotor 2. This position for the reading head 10 to record the signal is described herein as the "eye of the reading head" and is referred to in FIG. 2 by the numeral 12. This eye, for example, can be the focal point of a lens, not shown, which is arranged in front of the reading head 10.

In all of the examples the radius of curvature $r_u$ of the circular path of the palettes is greater than the radius of curvature $r_E$ of the individual removal palettes 4. The term "radius of curvature of the circular path of the palette" is understood as the radius $r_u$ drawn in FIG. 4, that is, the radius of the circle around the palettes in the center position. The swivel axis, that is, the axis of the palette shafts 11 is referenced in FIGS. 2 to 4 by $S_E$ and passes along the dash-dot path $B_2$.

For the reading head 10 in FIG. 2 to carry out observations at a constant distance "a" to its optical eye 12 the center of curvature $K_E$ of the palette surfaces 3 is led around a circular path $B_1$ around the optical eye 12. Hence, the imprint on the labels adhering to the palette surfaces always have a constant distance "a" to the reading head while traveling past the head 10. Thus, the reading head can precisely carry out the reporting process with appropriately adjusted depth of focus. The palette is thereby swivelled in the direction of the arrow $P_2$.

Figure 3:
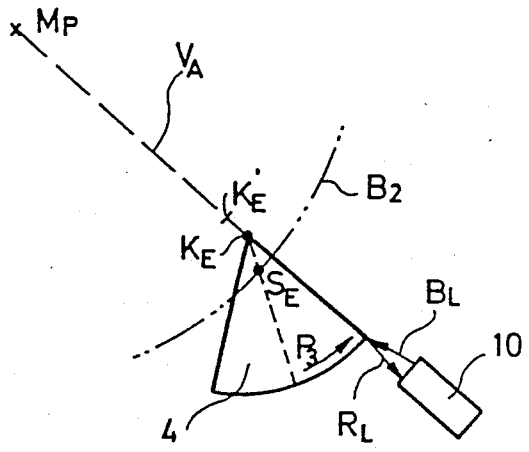
FIG. 3 is an embodiment in which the center of curvature of the palette, while swinging past the reading head, is maintained on the axis between the center of rotation of the palette rotor and reading head.

A second possible movement of the palettes 4 past the reading head 10 is depicted in FIG. 3. This arrangement is advantageous where the reading head uses reflected light and the reading head is required to identify the imprint at certain label positions such as to the left or right of the central axis of the palettes 4. In the FIG. 3 arrangement, the illuminating light $R_L$ emitted from the reading head 10 is reflected at a constant angle, that is, the reflected light beam $R_L$ does not change its position of appearance in the reading head 10 as the palette travels past the head. This is achieved as a result of the center of curvature $K_E$ of the palette being maintained on the connecting axis $V_A$ which connects the optical eye 12 of the reading head with the center optical eye 12 of the reading head with the center point $M_P$ of the palette rotor during the time that the palette swivels past the head. The center $K_E$ of curvature thereby travels radially inward in the direction toward the center $M_P$ of the palette rotor into the position which is represented by $K'_E$ and again goes back to the position $K_E$ before it proceeds again. The swivel motion of the palette is, in this case, in the same direction as the motion in the FIG. 2 example and in FIG. 3 as indicated by the arrow $P_3$.

In the FIG. 3 arrangement, however, relatively great forces can occur, since the palettes must carry out a very rapid swivel motion in order to achieve the described sequence of movements.

Figure 4:
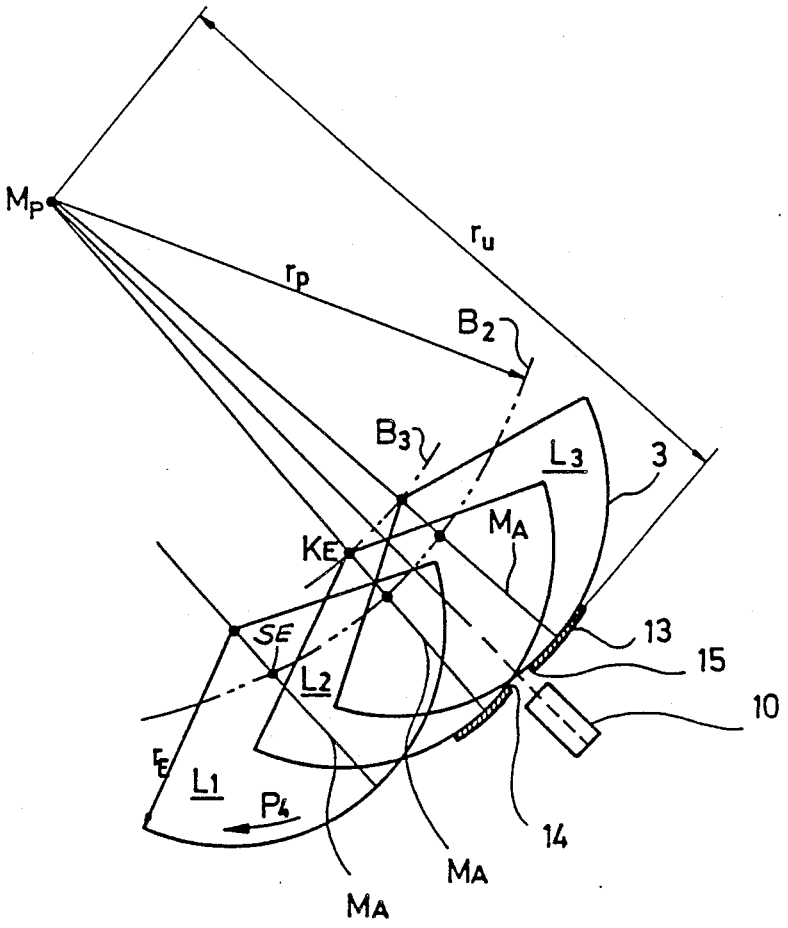
FIG. 4 is an embodiment in which the center axis of the glue coated palettes point to the center point of the palette rotor while swinging past the reading head.

In the embodiment of the invention depicted in FIG. 4, the imprint on the label is applied symmetrically to the central radius of the palette surfaces 3.

In FIG. 4, three positions $L_1$, $L_2$, and $L_3$ are shown, which represent the sequence through which the individual palettes 4 move. Position $L_1$ shows the palette which has been moved to the reading head 10 such that its center axis $M_A$ points away from the axis $M_P$ of the palette rotor 2. The control cam 18 is now in a position to swivel the palette from the position $L_1$ back in the direction of the arrow $P_4$ until the center axis $M_A$ points to the center point $M_P$ of the palette rotor. This position is taken by the palette no later than when the leading edge 14 of the imprint enters into the reading zone of the reading head 10. After reaching position $L_2$, the palette now swivels neither backward nor forward, but rather the center of curvature $K_E$ is advanced on a circular path $B_3$ around the center point $M_P$ of the palette rotor, that is, the palette is moved on together with the rotor without its axis $M_A$ carrying out a swivel motion with respect to the radial direction of the rotor. This fixation of the palette occurs until the trailing edge 15 of the imprint 13 has traveled out of the zone of the reading head.

The sequence of movements described in FIG. 4 provides the advantage that the forces acting are very small, since the palettes are not swivelled. Of course, the distance at which the reading head 10 reads the imprint is changed during the reading procedure, whereby the reading distance is greatest at the front and rear edge and smallest in the middle of the imprint. With this arrangement, a reading head 10 is employed which has a tolerance or permissible depth of focus which is greater than or equivalent to this change in reading distance.

The invention is not limited to palette rotors which function with individual palettes having radii of curvature smaller than the radii of curvature $r_u$ of the circular palette path. The invention can also be used with palette rotors which function with palettes by which the operating radii of curvature are the same, and can also be employed with palette rotors which consist of rotating cylinders and have surfaces on the outer circumference. Also, the concept of a "reading head" is to be understood in the broadest terms, in particular, magnetic reading heads which can be employed when the printer uses magnetic inking fluid should also be included. Cameras can be employed as optical reading heads in the place of the simpler previously reflected light reading heads. It is also contemplated to employ the end of an optical photoconductor which then conducts light to a detection station situated farther away.

I claim:

1. Labeling apparatus including a rotor, a plurality of equiangularly spaced apart curved surface palettes carried on said rotor, a label magazine from which the palettes, respectively, withdraw a label as the palettes pass the magazine, gripping means for gripping and removing the labels from said palettes in succession, a printing mechanism arranged adjacent the path of movement of the labels on the palettes and positioned between the label magazine and the gripping means for imprinting the labels as they pass and the improvement comprising:

a reading head for monitoring the imprint after the label has passed said printing mechanism and before said label is removed from the palette by said gripping means, said rotor having a plurality of upright shafts on which said palettes are mounted, respectively, and means for controlling said shafts to turn said palettes as the palettes travel past said reading head, the radius of curvature ($r_E$) of the curved palette surfaces (3) is smaller than the radius of curvature ($r_u$) of the circular path of the palettes and said means for controlling said shafts to turn comprises a control cam which is followed by said shafts.

2. The labeling apparatus according to claim 1 wherein said reading head is an optical reading head.

3. The labeling apparatus according to claim 1 wherein said reading head is a magnetic reading head.

4. The labeling apparatus according to claim 1 wherein said reading head has an eye (12) at which said head senses said imprint, said control cam is constructed and arranged such that the center of curvature ($K_E$) of said palettes turns around said eye of said reading head in a circular path ($B_1$).

5. The labeling apparatus according to claim 1 wherein said means for controlling said shafts to turn said palettes is constructed and arranged such that the center of curvature ($K_E$) of said palettes is stationary on a line ($V_A$) between the center ($M_P$) of the rotor and the eye (12) of reading head (10) as the curved palette surfaces (3) turn as they pass the reading head.

6. The labeling apparatus according to claim 1 wherein said reading head has an eye (12) at which said head senses said imprint (13) and said imprint is applied to the label symmetrically relative to the central radius ($M_A$) of the curved palette surfaces (3) and said control cam is formed such that said central radius ($M_A$) of palettes (4) is situated in front of said eye of the reading head (10) in the radial direction of the palette carrying rotor (2) as the leading edge (14) of the labels arrives and remains aligned in the radial direction of the rotor until the trailing edge (15) of the imprint travels past the eye of the reading head.

* * * * *